United States Patent [19]

Balzer et al.

[11] Patent Number: 4,619,717

[45] Date of Patent: Oct. 28, 1986

[54] HEATING MAGNETIC METAL WORKPIECES

[75] Inventors: Norbert R. Balzer; David R. Soworowski, both of Boaz, Ala.

[73] Assignee: Park-Ohio Industries, Inc., Shaker Heights, Ohio

[21] Appl. No.: 602,914

[22] Filed: Apr. 23, 1984

[51] Int. Cl.[4] ..... H01F 1/04

[52] U.S. Cl. ..... 148/112; 148/121; 219/10.41; 219/10.57; 219/10.71

[58] Field of Search ..... 148/112, 121; 219/10.41, 10.43, 10.57, 10.71

[56] References Cited

U.S. PATENT DOCUMENTS

| | | | |
|---|---|---|---|
| 2,980,561 | 4/1961 | Ford et al. | 148/112 |
| 3,409,480 | 11/1968 | Forslund | 148/112 |
| 3,419,698 | 12/1968 | Palmero et al. | 219/10.71 |
| 3,421,925 | 1/1969 | Hair et al. | 148/112 |
| 3,423,253 | 1/1969 | Ames et al. | 148/112 |
| 3,469,052 | 9/1969 | Hatchard | 219/10.71 |

FOREIGN PATENT DOCUMENTS

| | | | |
|---|---|---|---|
| 58-104125 | 6/1983 | Japan | 148/121 |

*Primary Examiner*—John P. Sheehan

*Attorney, Agent, or Firm*—Body, Vickers & Daniels

[57] ABSTRACT

Method and apparatus for heating a billet of magnetic metal material to a forging or other elevated processing temperature above the Curie point temperature of the workpiece metal by first inductively preheating the billet in an induction heating coil to a preheat temperature not appreciably higher than the Curie point temperature of the workpiece metal, and then conveying the preheated billet from the induction heating coil into, and post-heating it to the elevated processing temperature within, the heating chamber of a slot-type high efficiency electric radiant heat electric furnace.

8 Claims, 10 Drawing Figures

FIG. 3
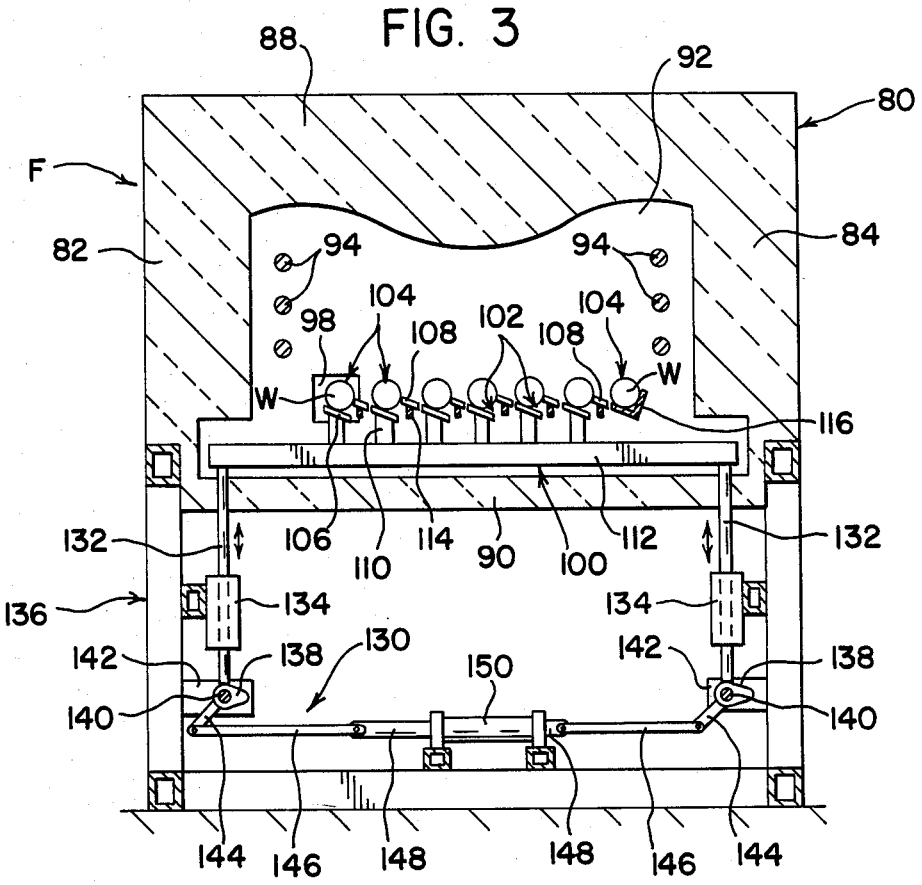
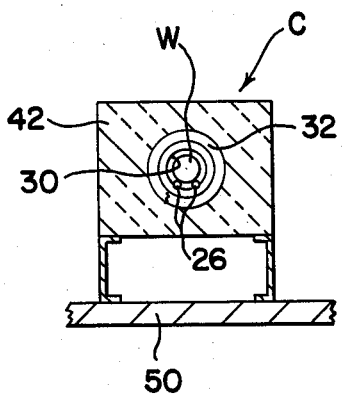
FIG. 4

HEATING MAGNETIC METAL WORKPIECES

BACKGROUND OF THE INVENTION

The present invention relates, in general, to method and apparatus for heating metal articles of magnetic material to an elevated processing or forging temperature.

In the metal forging art, it has been common practice for many years to heat billets or workpieces of magnetic material such as steel to their elevated forging temperature, e.g., around 2250° F. in the case of steel workpieces for forging articles therefrom, by an induction heating process utilizing an induction heating coil energized by a high frequency electrical power supply. It is, of course, well known that ferromagnetic or so-called magnetic metals such as steels commonly employed for metal forgings undergo a transition, during the heating thereof to their elevated forging temperature of around 2250° F. or so, from a magnetic state to a paramagnetic or substantially nonmagnetic state at the Curie point temperature of the metal which, in the case of such common forging steels, is generally around 1400° F. or so. For this and other reasons, therefore, the induction heating processes heretofore employed for heating the steel billets or workpieces to forging temperature have generally involved the use of high frequency electrical power supplies of various frequencies for energizing the induction heating coil in order to thereby improve the overall efficiency of the induction heating process. Due to its lower cost per kilowatt, a high frequency power supply of a comparatively low frequency level was normally employed for preheating the magnetic metal billets or workpieces throughout and slightly beyond their magnetic state temperature range, where the depth of penetration of the workpieces by the heating flux generated by the energized induction heating coil did not affect the overall efficiency of the heating process. Such lower frequency inductive preheating of the magnetic metal workpieces to their nonmagnetic state was then combined with a higher frequency inductive post-heating of the preheated workpieces, within their nonmagnetic state temperature range, to their elevated forging temperature of around 2250° F. to thereby improve the overall efficiency of the entire induction heating operation.

The normal overall efficiencies of induction heating processes such as heretofore employed to heat magnetic metal billets or workpieces to an elevated processing temperature such as their forging temperatures of around 2250° F. vary from an approximate minimum efficiency of around three pounds per kilowatt hour to a maximum efficiency of around six pounds per kilowatt hour. While efficiencies of this level have been accepted within the industry for many years, an improvement in the overall efficiency of heating processes for heating magnetic metal workpieces to their elevated processing or forging temperature has been a much desired object.

SUMMARY OF THE INVENTION

The present invention contemplates a novel method and apparatus for heating magnetic metal articles to an elevated processing temperature appreciably above their Curie point temperature which overcomes all of the above problems and others and provides a heating method and apparatus of significantly improved overall efficiency over the solely inductive heating methods and apparatus heretofore employed for such purpose.

Briefly stated, in accordance with one aspect of the invention, an induction heating coil energized by a high frequency electrical power supply of a relatively low frequency level is used to first preheat the magnetic metal articles to a preheat temperature not appreciably higher than the Curie point transition temperature of the workpiece metal at which it becomes paramagnetic or substantially nonmagnetic, and then a slot-type high efficiency electric radiant heat furnace is used to post-heat the preheated articles to their final elevated processing or forging temperature. By inductively preheating the magnetic metal articles to, or slightly above, their Curie point temperature in an induction heating coil energized by a relatively low level high frequency power supply, and then post-heating the so preheated articles to their final elevated processing or forging temperature in a high efficiency electric radiant heat furnace, the overall efficiency of the heating system is increased markedly over those systems wherein the articles are heated to a corresponding elevated processing or forging temperature entirely by an induction heating process.

In accordance with a further aspect of the invention, magnetic articles such as steel billets used in making metal forgings are first preheated to a preheat temperature at least corresponding to, or slightly above, the Curie point temperature of the metal articles by inductively heating the articles within an induction heating coil energized by a relatively low level high frequency electrical power supply, and then are transferred from the inductive heating coil immediately into and post-heated within a slot-type high efficiency electric radiant heat furnace to their forging temperature of around 2250° F. or so.

The principal object of the invention is to provide a novel method of heating a magnetic metal article to a selective elevated processing temperature above the Curie point temperature of the metal article.

Another object of the invention is to provide a novel method of heating a magnetic metal article to a selective elevated processing temperature above the Curie point temperature of the metal article which method is of high overall efficiency.

Still another object of the invention is to provide a novel two-stage method of heating magnetic metal articles to a selective elevated processing temperature above the Curie point temperature thereof partly by inductive preheating of the articles and partly by post-heating of the articles in a high efficiency electric radiant heat furnace.

A further object of the invention is to provide a novel method of heating a magnetic metal article to a selective elevated processing temperature which utilizes a combination of inductive preheating of the article to a preheat temperature at least equal to but not appreciably higher than the Curie point temperature of the metal article together with post-heating of the preheated article to the final selective processing temperature in a high efficiency electric radiant heat furnace.

A still further object of the invention is to provide a novel apparatus for heating magnetic metal articles to an elevated processing temperature which is of high overall efficiency.

Further objects and advantages of the invention will appear from the following detailed description of a preferred embodiment thereof and from the accompanying drawings.

BRIEF DESCRIPTION OF THE DRAWINGS

In the drawings:

FIG. 3 is a vertical section along line 3—3 of FIG. 2 showing the electric radiant heat furnace component of the apparatus:

FIG. 4 is a vertical section along line 4—4 of FIG. 2 showing the induction heating coil component of the apparatus;

DESCRIPTION OF THE PREFERRED EMBODIMENTS

Figure 1:
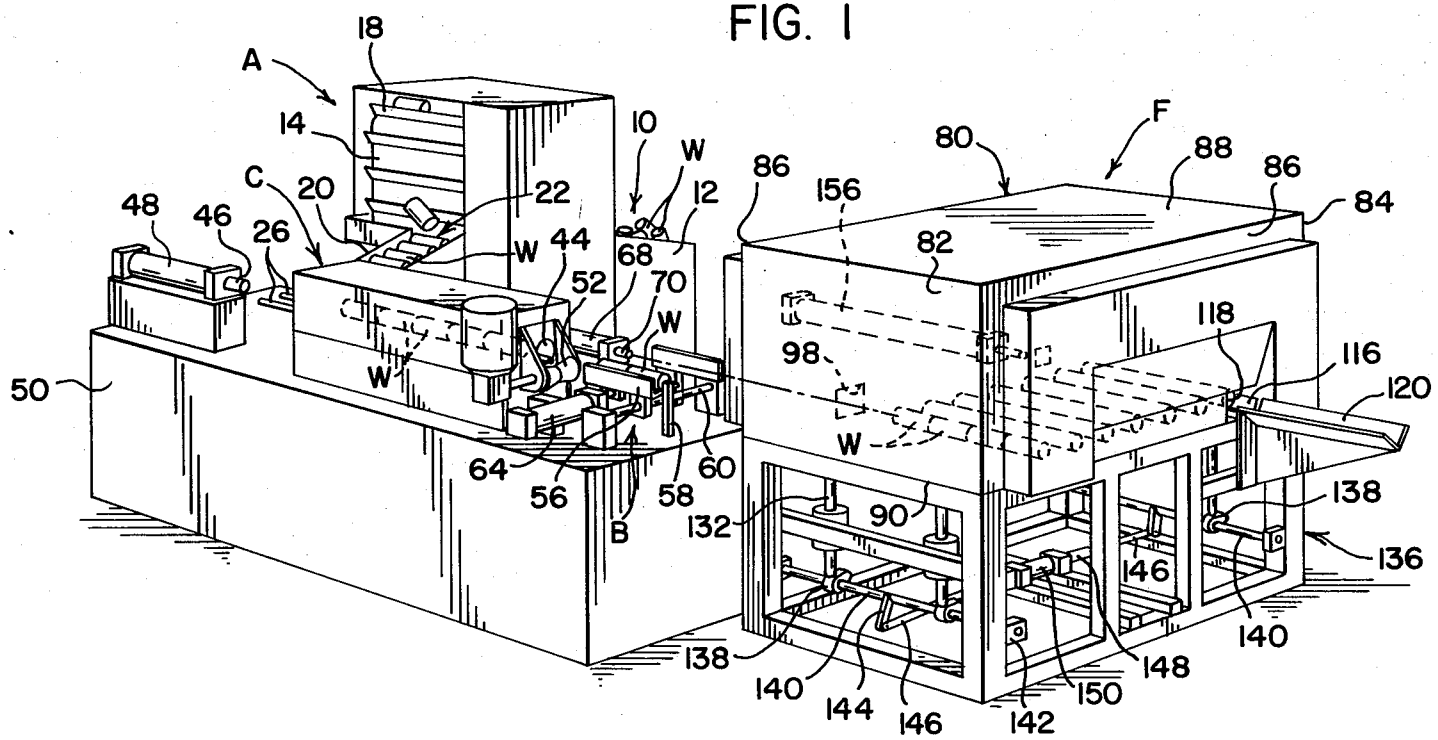
FIG. 1 is a perspective view of a representative apparatus according to the invention for heating magnetic metal articles to an elevated processing temperature by the method comprising the invention.

Referring now to the drawings wherein the showings are for the purposes of illustrating preferred embodiments of the invention only and not for the purpose of limiting the same, the Figures show the invention as embodied in a method and apparatus for heating metal articles of magnetic material, such as billets or workpieces W of steel such as commonly employed for metal forgings, to the forging temperature of the articles preparatory to the production of forgings therefrom. It should be understood, however, that the invention may be utilized for heating articles of other metallic materials to their forging or other elevated processing temperature wherever it may be found to have suitable utility therefor. For the heating to a forgeable condition of workpieces W of magnetic metal material such as the aforementioned steels commonly used for metal forgings, they must be heated to a temperature of around 2250° F. or so.

In accordance with the invention, the workpieces W are heated to their forging or other elevated processing temperature by a process which combines the heating efficiencies of induction heating of the workpiece metals while in their magnetic state with the heating efficiencies of electric radiant furnace heating of the workpiece metals while in their nonmagnetic state. To this end, and as generally illustrated schematically in FIG. 10, the workpieces W are heated to their forging or other elevated processing temperature by a combination of initial preheating thereof in an induction heating coil C to an elevated preheat temperature $T_1$ not appreciably higher than the Curie point temperature of the metal workpieces coupled with radiant post-heating of the workpieces to their final selective processing temperature $T_2$ in a high efficiency type electric radiant heat furnace F. In the case, for example, of workpieces W of magnetic metal such as steel commonly employed for metal forgings, they are initially preheated in the induction heating coil C to a temperature around 1400° F. corresponding to or slightly above the Curie point temperature of the particular workpiece steel and then radiantly post-heated to their selective forging temperature of around 2250° F. in the high efficiency electric radiant heat furnace F. For the purposes of the invention, the electric furnace F may be any suitable so-called high efficiency type electric radiant heat furnace such as, for example, the slot-type electric radiant heat furnace disclosed in U.S. Pat. No. 4,159,415 to Williams.

By first inductively preheating the workpieces W to a preheat temperature $T_1$ not appreciably higher than the Curie point temperature of the workpiece metal in an induction heating coil C and then post-heating the preheated workpieces to their final selective processing or forging temperature $T_2$ in a high efficiency electric radiant heat furnace F, a total heating system is provided which is of markedly increased overall efficiency as compared to the prior heating systems in which the magnetic metal workpieces are heated to their forging temperature entirely by an induction heating process. The normal efficiencies of such inductive heating processes for heating magnetic metals to their forging temperatures of around 2250° F. varies from an approximate minimum efficiency of around three pounds per kilowatt hour to a maximum efficiency of around six pounds per kilowatt hour. In comparison, the overall efficiency of the two step heating system according to the invention, which combines the step of inductively preheating the workpieces to a preheat temperature $T_1$ not appreciably higher than their Curie point temperature with the step of post-heating the workpieces to their final forging temperature $T_2$ in an electric radiant heat furnace, approaches 7.5 pounds per kilowatt hour. Thus, a minimum efficiency improvement of 1.5 pounds per kilowatt hour, which translates into a minimum savings of 25% in electrical energy cost, is realized by the use of the two step heating process according to the invention.

Referring now to FIGS. 1–4 which illustrate generally a preferred form of apparatus for carrying out the novel method comprising the invention for heating metal workpieces of magnetic metal, such as steel commonly used for making metal forgings, to an elevated processing temerature such as their forging temperature $T_2$, a feed means A is adapted to feed the workpieces W from a supply or pile 10 thereof in a hopper 12 into the induction heating coil C. The magnetic workpieces W, in the particular case illustrated, are in the form of comparatively short lengths of steel rod.

The workpiece feed means A may comprise a vertically movable endless conveyor belt 14 either continuously or intermittently driven, as required by the need for a row supply of the workpieces W from the hopper 12 for feeding into the coil C during the normal operation of the apparatus, by an electric motor-speed reducer drive unit 16. The conveyor belt 14 is provided with a plurality of horizontally extending lift troughs 18 which, during their upward travel, pass through the supply 10 of the workpieces in the hopper to pick-up one or more of the workpieces and suitably deposit them, as by tilting of the trough 18 or by any other manner of ejection therefrom, into a stationary downwardly inclined chute 20. The workpieces are deposited as shown in a crosswise position in the chute 20 down which they then roll into a rest position against the row 22 of workpieces previously deposited in the chute. The row 22 of workpieces in the chute 20 is retained in place therein by the retaining or stop fingers 24 of a suitable workpiece escapement mechanism located at the bottom end of the chute and actuated either manually, or in response to an appropriate signal such as an electrical pulse, to momentarily disengage from the row of workpieces in the chute and release the workpieces one at a time from the bottom end thereof.

On being released from the chute 20 by the retaining fingers 24, each workpiece rolls down onto and is supported by a pair of parallel horizontally extending support or slide rails 26 in a position in longitudinally aligned relation therewith and in a feed-in position directly opposite the entrance end 28 of an elongated cylindrical workpiece passageway 30 in the induction heating coil C. The slide rails 26 extend completely through the coil passageway 30 and they support each workpiece in axially aligned relation with the coil passageway for sliding movement therethrough along the slide rails.

Figure 2:
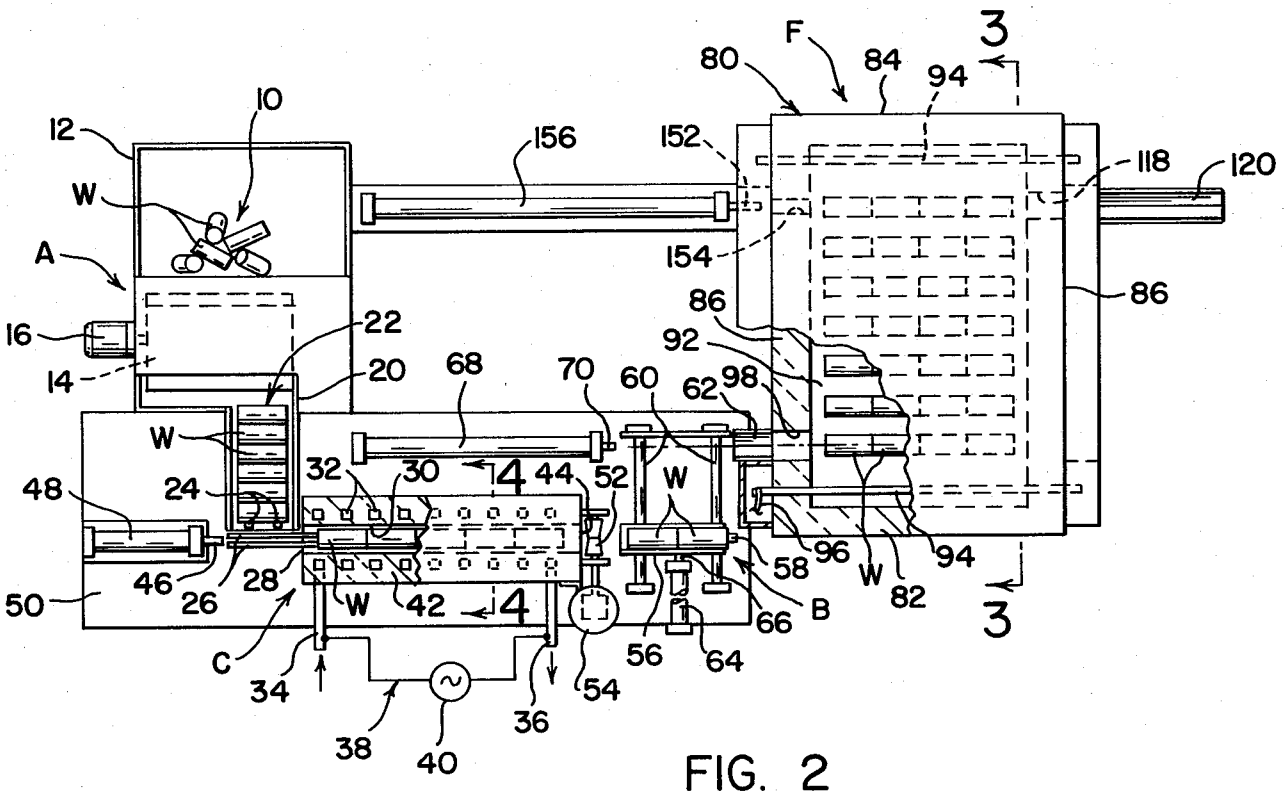
FIG. 2 is a plan view of the apparatus shown in FIG. 1 with the electric furnace and induction heating coil components thereof shown partly broken away in section.

As shown in FIGS. 2 and 4, induction heating coil C is of a conventional multiturn type comprising a hollow electrical conductor helically coiled in a plurality of convolutions 32 about a linear coil axis and connected at its opposite ends to a coolant inlet 34 and a coolant outlet 36 which are connected to a supply (not shown) of a suitable coolant. Inlet 34 and outlet 36 form spaced connector leads for connecting the full length of the coil by means of electrical circuit 38 across an appropriate high frequency AC power supply schematically illustrated as a generator 40 to continuously energize the coil C during the operation of the apparatus. The convolutions 32 of the heating coil C are shown embedded in a body of refractory material 42 formed with the elongated central workpiece receiving passageway 30 which extends coaxially with the central coil axis.

Following the discharge of each workpiece W from the chute 20 and onto the slide rails 26, the workpiece is then slidably indexed along the slide rails into the open feed-in end 28 of the passageway 30 of the continuously energized coil C to initiate the inductive preheating of the workpiece. During its feed-in movement through the coil passageway 30, the inserted workpiece abuts against the last one of the workpieces previously introduced into the coil passageway and pushes ahead the entire row of workpieces present therein a sufficient distance, corresponding to the length of one of the workpieces, to eject the forwardmost one of the workpieces in the workpiece row out of the other or discharge end 44 of the coil passageway, the ejected workpiece having been preheated by that time to a preheat temperature $T_1$ not appreciably higher than, and preferably corresponding to or slightly above, the Curie point temperature of the workpiece metal. The workpieces W in the row thereof in the coil passageway 30 thus are advanced step-by-step therethrough and progressively preheated therein by the energized coil C until they reach the preheat temperature $T_1$ at the outlet or discharge end 44 of the passageway 30 at which time they are ejected therefrom.

The sliding movement of each workpiece along the slide rails 26 from its feed-in position thereon into and through the coil passageway 30 may be effected by a push rod 46 which may comprise the piston rod of a hydraulic cylinder 48 mounted on the apparatus frame or bed 50, with the piston rod 46 aligned with the workpiece W supported on the slide rails 26 in feed-in position thereon opposite the entrance end 28 of the coil passageway 30. Actuation of hydraulic cylinder 48 to effect the introduction of a workpiece in feed-in position on the slide rails 26 into the coil passageway 30 occurs each time the forwardmost one of the workpieces in the row thereof being preheated in the coil passageway reaches the preheat temperature $T_1$ and is ready for discharge therefrom. The actuation of the hydraulic cylinder 48 at such time may be effected, for example, by a suitable electric signal or pulse to a solenoid operated control valve (not shown) of the control means that regulates the operation of the cylinder 48. The determination of when the forwardmost one of the workpieces W in the row thereof in the coil passageway 30 has reached the preheat temperature $T_1$ and is ready for ejection may be determined, for example, by a suitable timer (not shown) which controls the time period during which each workpiece is advanced through the coil passageway 30 and being preheated by the continuously energized coil C, the timer transmitting the aforementioned electrical signal to the control valve for the hydraulic cylinder 48 at the end of each such time period.

The ejected preheated workpiece W from the coil passageway 30 rides onto a continuously rotating, shallow V-groove drive roller 52 which is driven by an electric motor-speed reducer unit 54. The rotating drive roller 52 imparts a forward endwise thrust to the workpiece W to cause it to slide forward onto a slightly V-shaped horizontally movable cradle 56 of a cross slide carriage mechanism B and abut against a fixed limiting stop 58. As shown in FIGS. 1 and 2, the cradle 56 is preferably arranged to accept and support two of the preheated workpieces at a time as they are successively indexed out of the induction heating coil passageway 30, the second workpiece being driven by the rotating drive roller 52 onto the cradle 56 and into abutting endwise relation with the first workpiece already present thereon so that the two workpieces are supported on the cradle in aligned and abutting endwise relation with one another.

The cross slide carriage mechanism B is mounted on the apparatus frame 50 and includes a pair of parallel horizontal guide rods 60 extending transversely of the linear coil axis of the induction heating coil C and on which the cradle is slidably supported for horizontal reciprocable sliding movement transversely of the axis of coil C between a retracted position as shown in FIGS. 1 and 2 for receiving the workpieces W ejected from the coil passageway 30, and an advanced position for locating the two workpieces in the cradle 56 in a position opposite the workpiece feed-in guide channel 62 on the furnace F for introduction thereinto. The sliding reciprocation movement of the carriage cradle 56 on the guide rods 60 may be effected, for example, by a hydraulic cylinder 64 mounted on the frame 50 and the piston rod 66 of which is connected at its outward end to the cradle. Cylinder 64 is actuated in timed relation to the operation of the cylinder 48 that feeds the workpieces W into the induction heating coil C so that the cradle 56, upon receiving a pair of the preheated workpieces from the coil C, is then reciprocated through both its advance and retraction strokes before the next succeeding one of the workpieces being heated in the coil C attains the preheat temperature $T_1$ and is ready for discharge therefrom by the operation of the cylinder 48. At the end of its advance stroke, the cradle 56 is momentarily held in its advanced position for a short time to permit the ejection of the workpieces from the cradle and into the guide channel 62 and into the furnace F before the initiation of the retraction stroke of the cradle. The ejection of the workpieces from the cradle 56 may be effected by a hydraulic cylinder 68 mounted on the apparatus frame 50 and the piston rod 70 of which engages endwise against the pair of workpieces in the cradle, on actuation of the cylinder 68, to push them out of the cradle and into and through the guide channel 62 and into the furnace F to initiate the post-heating of the workpieces to their final selected processing or forging temperature $T_2$.

The furnace F is shown generally as comprising a fire resistant housing 80 formed by vertically extending front, rear, and side walls 82, 84 and 86, respectively, and top and bottom walls 88 and 90, which walls all define a heating chamber 92 through which the preheated workpieces from the induction heating coil C are conveyed to effect the progressive heating thereof to their final selective processing or forging temperature $T_2$. A plurality of elongated rod or bar shaped electrical resistance heating elements 94 made of silicon carbide elements, for example, are mounted within the chamber 92 to heat and maintain the atmosphere therein at the aforementioned selective processing temperature $T_2$, e.g., at the forging temperature of the steel billets or workpieces W which ordinarily is around 2250° F. A plurality ( three in the particular case shown) of the heating elements 94 extend horizontally in vertical spaced relation to each other and in inwardly spaced parallel relation to each of the front and rear walls 82 and 84 of the furnace housing 80. The heating elements extend through the refractory lined side walls 86 of the housing to the outside of the furnace where they are connected, as by circuit leads 96 (FIG. 2), to a suitable source of electrical power (not shown), e.g., one to each phase of a three phase 60 Hz source of a suitable voltage such as 480 volts, as denoted in FIG. 10 by the three circuit phases ph1, ph2 and ph3 of the power circuit.

On feeding of each pair of workpieces W from the cross slide cradle 56 into and through the guide channel 62 and into the furnace F by the piston rod 70 of hydraulic cylinder 68, the workpieces are pushed through a feed-in opening 98 (FIGS. 2 and 3) in the furnace side wall 86 of minimal workpiece passage size and onto a step-by-step workpiece transport mechanism 100 in the furnace chamber 92 for advancing the workpieces in a step-by-step manner therethrough. As shown particularly in FIG. 3, the transport mechanism 100 comprises a series of successive side-by-side parallel support cradles 102 for supporting therein successive rows 104 of the workpieces, each row comprising four of the workpieces, and advancing each workpiece row from one support cradle to the next. The cradles 102 are comprised of alternate horizontally extending, vertically movable, rearwardly declining parallel rest bars 106 and alternate horizontally extending, rearwardly declining, fixed parallel stop bars 108. The workpieces W rest on the movable rest bars 106 and against the longitudinal side edges of the fixed bars 108. The vertically movable rest bars 106 are all supported at each end on respective supports 110 upstanding from a pair of parallel side lift bars 112 extending horizontally within the lowermost region of the furnace chamber 92 alongside each of the side walls 86 thereof. The fixed stop bars 108 are supported on cross bars 114 anchored at their opposite ends in the furance side walls 86.

When the rest bars 106 are elevated a sufficient distance by the lift bars 112 to raise the rows 104 of workpieces W in the cradles 102 above the rest edges of the fixed stop bars 108, the workpieces of each row then roll or slide down onto the top of the respective fixed stop bar and against the edge of the next adjacent movable rest bar 106. On subsequent downward return of the rest bars to their lowered cradle forming position, the workpieces then roll or slide down onto the top of and rest on such next adjacent movable rest bar 106 within the cradle 102 formed thereby. Thus, the rows 104 of workpieces W in each cradle are progressively advanced step-by-step from one cradle to the next through the furnace chamber 92. From the last one of the cradles 102 in the furnace, the row 104 of workpieces therein roll or slide off the fixed stop bar 108 of such last cradle and into a horizontally extending V-section feed-out trough 116, in position for discharge from the furnace F through a discharge opening 118 (FIGS. 1 and 2) of minimal workpiece passage size in the side wall 86 of the furnace housing 80 and into a suitable receptacle or collector trough 120 for removal therefrom as by a forging press operator.

The vertical reciprocation movement of the lift bars 112 to advance the rows 104 of workpieces W from one support cradle 102 to the next is produced by suitable elevator mechanism 130 of the workpiece transport mechanism 100. As shown particularly in FIG. 3, elevator mechanism 130 comprises respective pairs of vertically extending elevator rods 132 connected to and supporting the opposite ends of respective ones of lift bars 112. Elevator rods 132 extend through the bottom wall 90 of furnace housing 80 and are supported for vertical reciprocation movement in slide bearings 134 mounted on furnace support framework 136. Elevator rods 132 engage and rest at their lower ends against respective edge cams 138 all of the same cam edge shape and fixed in corresponding oriented position on horizontal parallel cam shafts 140 which extend transversely to lift bars 112 and are journaled at their opposite ends in bearing brackets 142 extending from furnace framework 136. Drive arms 144 of the same form and fixed one on each shaft 140 in corresponding oriented position thereon are pivotally connected at their outer or free ends to one end of respective horizontally extending drive rods 146 which are pivotally connected at their other ends to the opposite ends of a horizontally extending common piston rod 148 extending outwardly from each end of a hydraulic cylinder 150 mounted on furnace framework 136. Actuation of the cylinder 150 in one direction rotates the cams 138 so that the rise portions thereof raise the elevator rods 132 and lift bars 112 in unison which then raise the rest bars 106 of the workpiece cradles 102 to their elevated position to cause the workpieces therein to roll or slide down off the cradle rest bars 106 and onto the fixed stop bars 108 of the cradles in position to roll or slide down into the next forward one of the cradles 102 when formed by the subsequent lowering of the rest bars 106 to their lowered position by the operation of the cylinder 150 in the opposite direction. The operation of the cylinder 150 of the transport mechanism 100 to effect the step-by-step advance of the rows 104 of workpieces through the furnace F may be controlled either manually or automatically, for example, in response to an electrical signal signifying that the feed-out trough 116 of the furnace is empty of workpieces. The duration of the step-by-step advance movement of the workpieces through the furnace chamber 92 is regulated so that the workpieces will be at the selected processing temperature $T_2$, such as the forging temperature of, for example, around 2250° F. in the case of steel billets W to be made into forgings, by the time the workpieces are advanced into the feed-out trough 116 of the furnace. Also, the operating cycle of the workpiece transport mechanism 100 is controlled so as to take place in substantial timed sequence with the preheating of the workpieces in the induction heating coil C to the preheat temperature $T_1$ and feeding thereof into the furnace, thereby to assure the return of the first one of the workpiece supporting cradles 106, now empty of workpieces, to its workpiece receiving position aligned with the workpiece feed-in opening 98 of the furnace and in readiness to receive the preheated workpieces from the induction heating coil before the start of the next operating cycle of the workpiece feed-in hydraulic cylinder 68. Also, in the particular case illustrated wherein the workpiece supporting cradles 102 in the furnace F are adapted to each support four of the workpieces W in axially abutting alignment, the operation of the workpiece transport mechanism 100 is so controlled as to maintain the first one of the workpiece supporting cradles 102 in its workpiece receiving position aligned with the feed-in opening 98 of the furnace throughout two successive workpiece feed-in operating cycles of the workpiece feed-in hydraulic cylinder 68 which only feeds two of the workpieces at a time into the furnace during each of its operating cycles.

On reaching the feed-out trough 116, the finally heated workpieces W now at the selective processing temperature $T_2$ are discharged one at a time therefrom and out of the furnace F through the discharge opening 118 thereof and into the receptacle or collector trough 120 for removal therefrom by the forging press operator. The discharging of the finally heated workpieces at the temperature $T_2$ from the feed-out trough 116 of the furnace F may be accomplished by any suitable means as by a push rod 152 (FIG. 2) aligned with and reciprocable through opening 154 in the furnace side wall 86 and aligned with the row 104 of workpieces in the feed-out trough 116. The push rod 152 may be operated either manually or, as shown, automatically as by means of a hydraulic cylinder 156 the piston rod of which serves as the push rod 152 and is adapted to advance slowly or in progressive steps on its workpiece feed-out stroke so as to discharge the workpieces one at a time from the feed-out trough 116 and into the collector trough 120 and in substantial timed sequence with the dwell period of the workpiece transport mechanism 100.

From the above description, it will be apparent that the apparatus according to the invention operates either in a manually or an automatically controlled manner to provide a substantially continuous supply of workpieces or billets W of magnetic metal heated to a forging or other elevated processing temperature $T_2$ by the highly efficient two-stage heating process comprising the invention. By using the apparatus comprising the invention, a heating system is provided having a greatly increased overall efficiency affording a minimum savings of around 25% in electrical energy cost over the attendant energy cost of prior heating systems in which the magnetic metal workpieces are heated to their forging temperature solely by induction heating methods.

Figure 5:
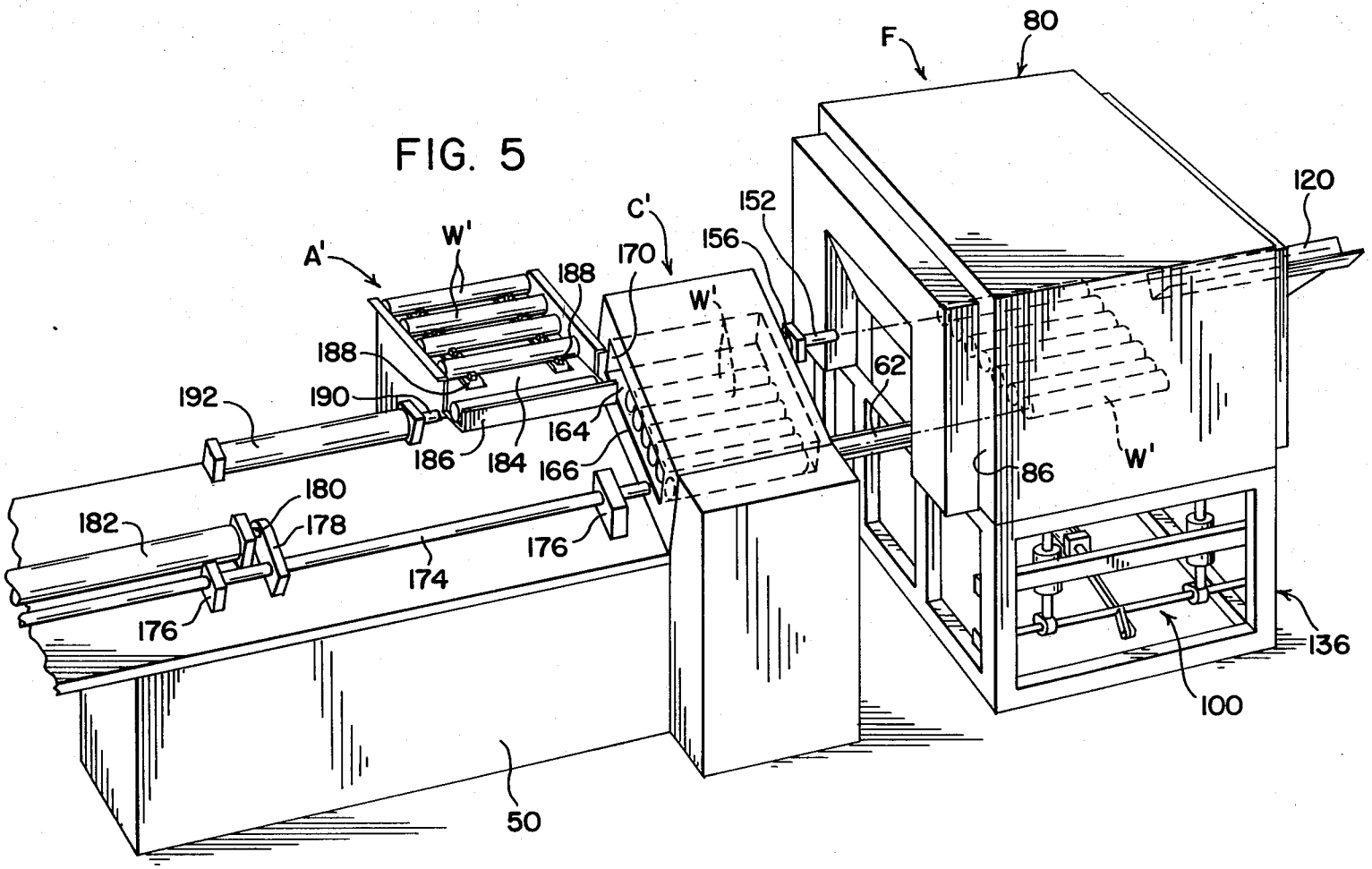
FIG. 5 is a perspective view of a modified form of apparatus for carrying out the method comprising the invention.
Figure 6:
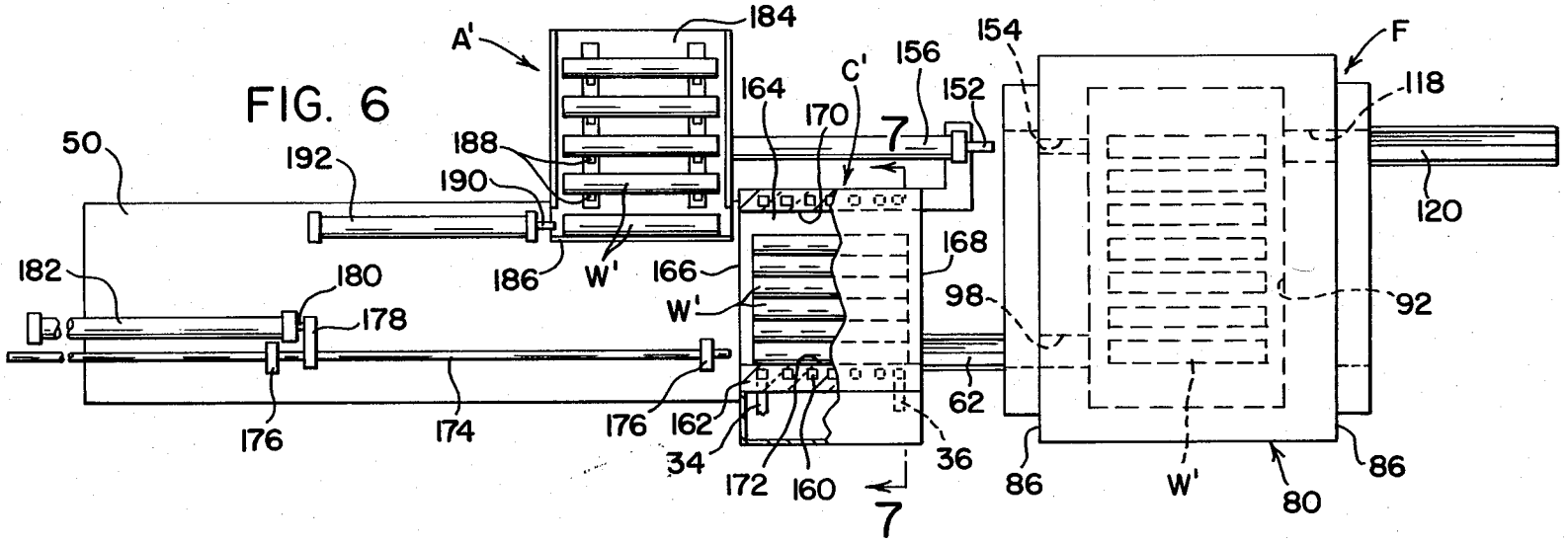
FIG. 6 is a plan view of the apparatus shown in FIG. 5 with the induction heating coil component thereof shown partly broken away in section.
Figure 7:
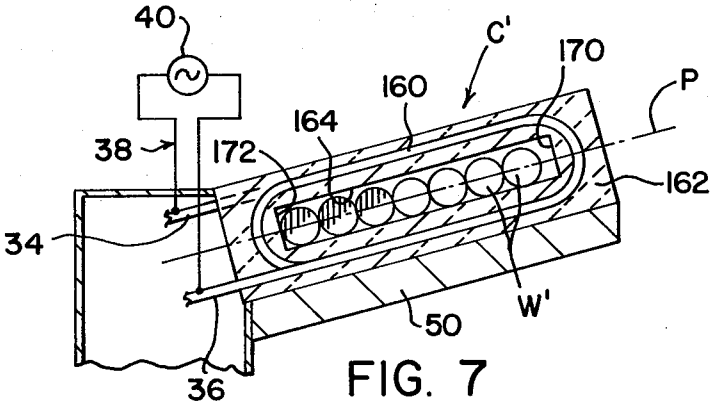
FIG. 7 is a vertical section on the line 7—7 of FIG. 6 showing the induction heating coil component of the apparatus shown in FIGS. 5 and 6.

FIGS. 5–7 illustrate a modified form of apparatus for carrying out the two-stage heating method comprising the invention to heat to an elevated processing temperature $T_2$ magnetic metal workpieces W′ of somewhat longer length than the workpieces W shown in FIGS. 1–4. This modified apparatus differs from that of FIGS. 1–4 mainly in the form of the induction heating coil C′ employed to preheat the workpieces W′ to the preheat temperature $T_1$ and the feeding arrangement for feeding the workpieces into and discharging them from the heating coil C′ and into the furnace F for heating them to the final processing temperature $T_2$. Thus, the induction heating coil C′ in this case is of an oval multiturn type having a hollow electrical conductor coiled in a plurality of convolutions 160 of flattened oval shape form as shown in FIG. 7 and, like the coil C, provided at its opposite ends with a coolant inlet 34 and a coolant outlet 36. As before, the inlet and outlet 34 and 36 form connector leads for connecting the full length of the coil by electrical circuit 38 across high frequency AC power supply 40 to continuously energize the coil C′ during the operation of the apparatus.

The coil convolutions 160 are embedded in a body 162 of refractory material which is formed with elongated, slot-shaped, workpiece receiving passageway 164 approximately in the axial plane P of the coil convolutions. The passageway 164 extends through the refractory body 162 from one end of the coil convolutions to the other and is open at its opposite ends to provide an entrance or feed-in end 166 and an exit or discharge end 168. The heating coil C′ is mounted on the apparatus frame 50 with the workpiece receiving passageway 164 and the center plane P of the coil in a slightly inclined or sloping position so that workpieces W′ are able to roll or slide by gravity down the inclined slot-shaped coil passageway 164 from its elevated end 170 to its lower end 172.

The workpieces W′ are introduced into the coil passageway 164 so as to rest side-by-side against one another and roll down the passageway in step-by-step fashion to the lower end thereof. During the step-by-step rolling movement of the workpieces down the sloping coil passageway 164, they are progressively heated by the energized coil C′ to the aforementioned preheat temperature $T_1$, at which time each such preheated workpiece then is immediately transferred endwise into the furnace F for post-heating of the workpieces therein to the final elevated processing or forging temperature $T_2$, in the same manner as in FIGS. 1–4. The endwise transfer of the workpieces into the furnace may be effected by a reciprocable push rod 174 slidably supported in slide bearings 176 on the apparatus frame 50 in alignment with the lowermost one of the workpieces in the coil passageway 164. The push rod 174 may be connected by tie arm 178 to the piston rod 180 of a hydraulic cylinder 182 mounted on the apparatus frame 50 for reciprocation of the push rod 174 so as to abut against the end of the lowermost workpiece in the sloping coil passageway 164 and push it out therefrom onto and through the guide trough 62 and into the furnace F through the feed-in opening 98 in the furnace side wall 86.

During the normal operation of the apparatus illustrated in FIGS. 5–7, the workpieces W′ are successively fed one at a time completely into the elevated end 170 of the slot-shaped coil passageway 164 through the open feed-in end 166 thereof by feed mechanism A′ comprising a sloped feed chute 184 for holding a supply of the workpieces W′ in parallel side-by-side relation for step-by-step rolling movement down the chute. The workpieces are intermittently released to progressively roll down the chute, and they are discharged one at a time from the lower end of the chute against a limiting stop 186 thereon to position the discharged workpiece in feed-in position for longitudinal sliding movement into the elevated end 170 of the sloping coil passageway 164. The workpieces W′ in the feed chute 184 are normally retained in position therein by suitable escapement mechanism including escapement fingers 188 which normally project above the chute bottom to engage and hold the workpieces in place in the chute. The escapement fingers are periodically withdrawn below the level of the chute bottom to release the workpieces in the chute so that they can roll down the chute step-by-step, the lowermost one of the workpieces in the chute being released at such time to rest against the stop 186 to locate it in proper aligned feed-in position for endwise feed-in movement into the elevated end of the sloped coil passageway 164. The endwise feed-in movement of the workpiece resting against the stop 186 into the coil passageway 164 may be effected by the piston rod 190 of a hydraulic cylinder 192 mounted on the apparatus frame 50. The piston rod 190 is aligned with and adapted to abut against the end of the workpiece W′ resting against the stop 186 to push the workpiece endwise into the upper end of the coil passageway on actuation of the cylinder 192.

The operation of the workpiece ejecting and feed-in cylinders 182 and 192 are controlled so as to be actuated in proper time sequence relative to each other and to the transport of the workpieces W′ through the furnace F by the transport mechanism 100. To this end, the feeding into the furnace F of each preheated workpiece W′ located at the lower end of the coil passageway 154 is initiated by the hydraulic cylinder 182 only after and as soon as the workpiece transport mechanism 100 of the furnace has completed its retraction stroke, following one of its step-by-step advance strokes, in order to thereby assure that the first one of the workpiece supporting cradles 102 in the furnace has been emptied of its workpieces and is in proper workpiece receiving position opposite the workpiece feed-in opening 98 of the furnace. Likewise, the feeding of a workpiece into the elevated end 170 of the induction heating coil passageway 164 by the hydraulic cylinder 192 is effected only after the workpiece feed-in cylinder 182 and the push rod 174 reciprocated thereby have returned to their retracted position following the feeding by this cylinder of a workpiece from the coil passageway 164 into the furnace. This then permits the several workpieces W′ in the coil passageway to roll down through one of their step-by-step advance movements in this passageway to thereby provide a cleared workpiece receiving space at the elevated end 170 of the coil passageway for the accommodation therein of the next workpiece to be introduced into the coil passageway by the hydraulic cylinder 192. Suitable control means (not shown) for achieving the above described time sequence of the operations of the workpiece transport mechanism 100 and the workpiece feeding hydraulic cylinders 182 and 192 are well within the knowledge of those skilled in the art and need not be further described herein.

Following the approximately immediate transfer of the workpieces W′ at the preheat temperature $T_1$ from the induction heating coil C′ into the furnace F, they are then post-heated therein, during the course of their step-by-step travel through the furnace heating chamber 92, to their final selective processing or forging temperature $T_2$ in the same manner as in FIGS. 1–4. On reaching their final indexed or discharge position within the furnace chamber 92 aligned with the furnace discharge opening 118, the post-heated workpieces have then attained the selected processing or forging temperature and are ejected endwise from the furnace and into the collector trough 120. As in FIGS. 1–4, the ejection of the heated workpieces from the furnace is effected by the operation of the hydraulic cylinder 156 to reciprocate the workpiece ejecting piston rod 152 thereof through the furnace opening 154 so as to abut against the end of and push the workpiece out of the furnace and into the trough 120.

Figure 8:
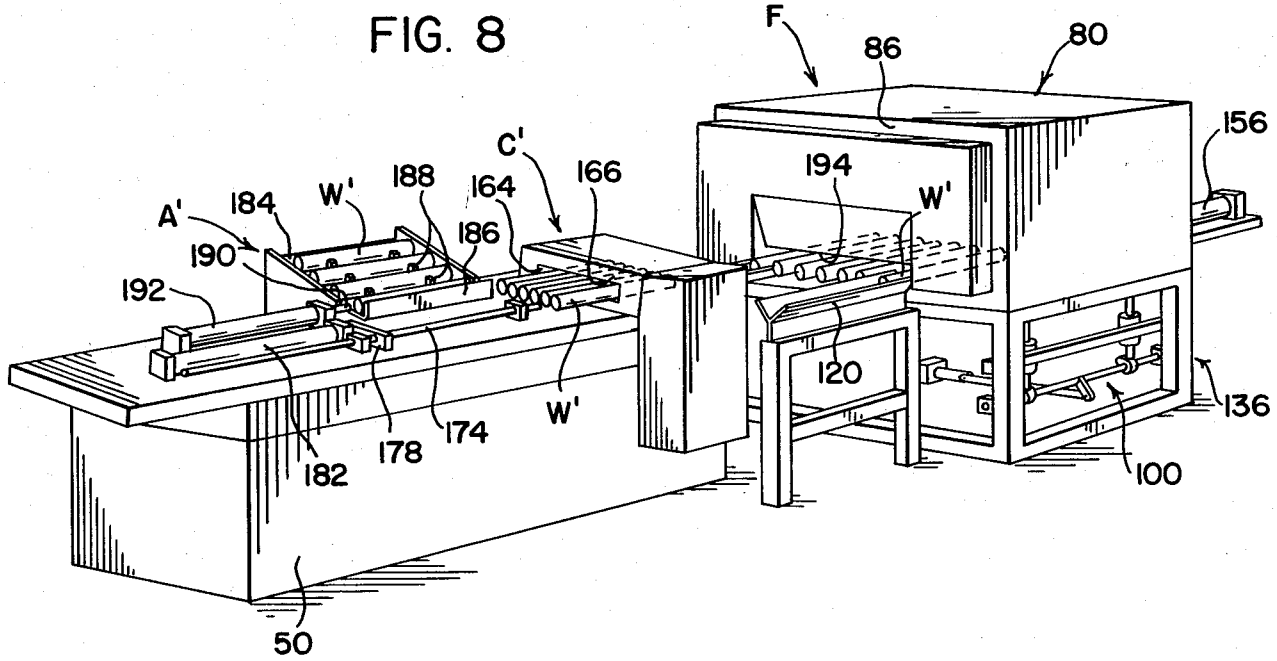
FIG. 8 is a perspective view of another modified form of apparatus for carrying out the method comprising the invention.
Figure 9:
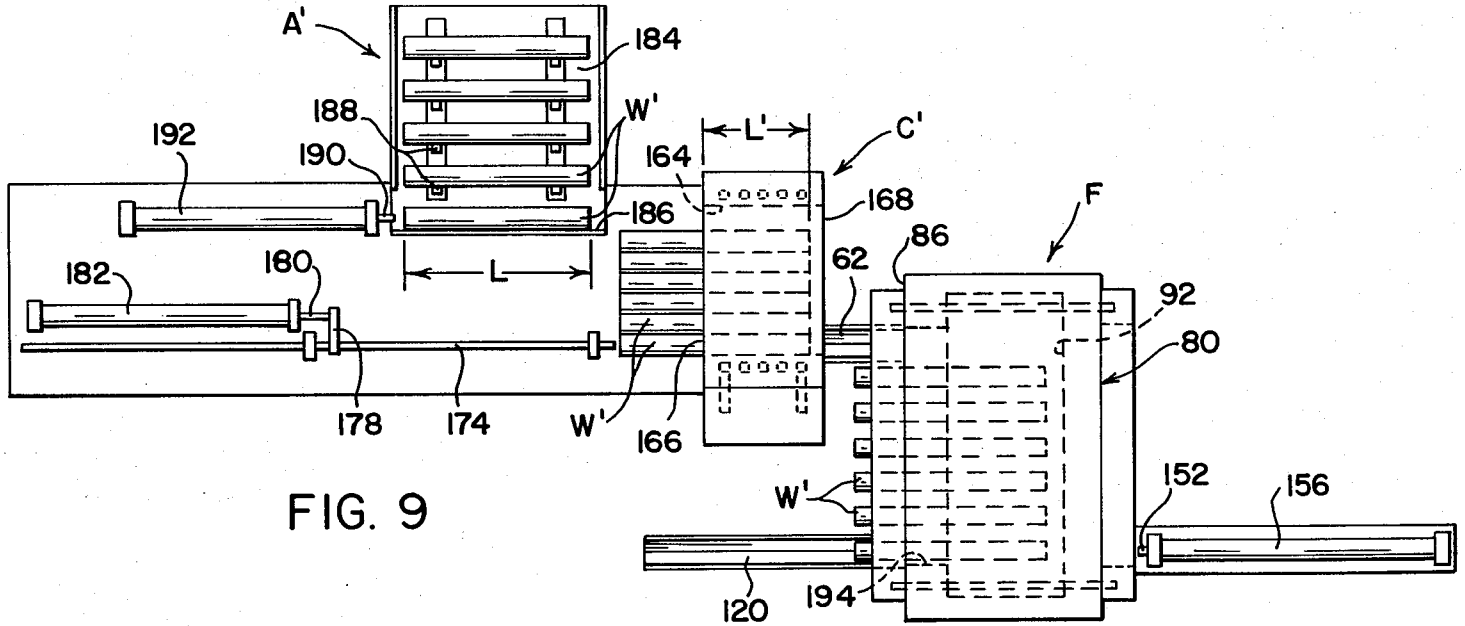
FIG. 9 is a plan view of the apparatus shown in FIG. 8.
Figure 10:
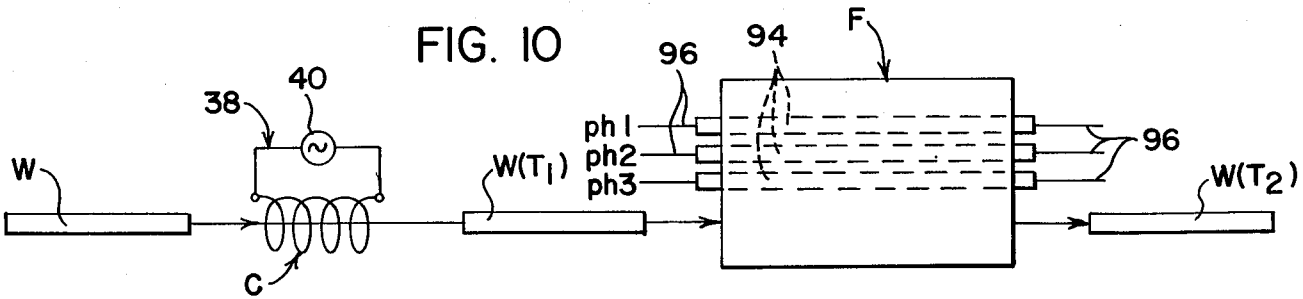
FIG. 10 is a schematic drawing illustrating the successive heating steps comprising the article heating method according to the invention.

The modified form of apparatus shown in FIGS. 8 and 9 for carrying out the workpiece heating method comprising the invention is similar to that shown in FIGS. 5–7 but instead is arranged to heat only a selective end length portion L′ (FIG. 9) of the total length L of the workpieces W′ to an elevated processing or forging temperature $T_2$, for processing or forging of only such heated end length portions L′ of the workpieces. To this end, the length of the stroke of piston rod 190 of workpiece feed-in cylinder 192 of the workpiece feed mechanism A′ is selected so as to feed the successive workpieces endwise the prescribed distance to introduce only the selective end length portions L′ of the workpieces into the induction heating coil passageway 164 and leave the remaining portion of the total length of the workpieces entirely outside the effective induction heating ambit of the coil C′, as shown. Similarly, the feeding stroke or throw of the piston rod 180 of hydraulic cylinder 182 is likewise selected to feed the successive workpieces W′ from the induction heating coil C′ endwise into the furnace F the prescribed distance to introduce only the selective end length portions L′ of the workpieces into the furnace heating chamber 92 while leaving the remaining portion of the length of the workpieces entirely outside the heating chamber. To permit the step-by-step transport of the workpieces W′ through the furnace chamber 92 by the workpiece transport mechanism 100, the furnace side wall 86 which faces the coil C′, instead of being merely provided with the relatively small size workpiece feed-in opening 98 as before, is provided instead with a horizontally extending slot-shaped workpiece feed-in and transport opening therethrough of sufficient height and horizontal length to freely accommodate therein the portions of the workpieces which project outside the furnace chamber 92 during the transport of the workpieces therethrough by the transport mechanism 100. The furnace F and workpiece transport mechanism 100 in FIGS. 8 and 9 is essentially the same as that shown in FIGS. 1–7 except for the direction of transport movement of the workpieces W′ through the furnace chamber 92 which, in the case of FIGS. 9 and 10, is reversed from that in FIGS. 1–7.

The invention has been described with reference to the preferred embodiments. Obviously, modifications and alterations will occur to others upon the reading and understanding of this specification. It is our intention to include all such modifications and alterations insofar as they come within the scope of the appended claims or the equivalence thereof.

Having thus described the invention, it is claimed:

1. The method of heating a workpiece of magnetic metal from about ambient temperature to a selective elevated processing temperature above the Curie point temperature of said workpiece metal comprising the steps of:

(a) initially inductively preheating the said workpiece from about ambient temperature to a preheat temperature of about the Curie point temperature of the workpiece metal in an induction heating coil energized by an electric power source; and, (b) then immediately radiantly post-heating said workpiece to said processing temperature in the heating chamber of an electric radiant heat furnace.

2. The method as defined in claim 1 wherein the said workpiece, during the said initial inductive preheating thereof, is heated to a preheat temperature above the said Curie point temperature of the workpiece metal.

3. The method as defined in claim 1 wherein the said workpiece is a steel billet and is post-heated in said furnace to a forgoing temperature of about 2250? F.

4. The method as defined in claim 1 wherein the said workpiece is composed of steel and is inductively preheated to a preheat temperature of at least 1400° F.

5. The method of heating a workpiece of magnetic metal from about ambient temperature to a selective elevated processing temperature above the temperature at which said metal is converted into a nonmagnetic state comprising the steps of:

(a) initially inductively preheating the said workpiece from about ambient temperature to a preheat temperature of about the said temperature at which the metal of the workpiece is converted into a nonmagnetic state; and, (b) then post-heating the said preheated nonmagnetic state workpiece to the said elevated processing temperature in the heating chamber of an electric radiant heat furnace.

6. The method as defined in claim 5 wherein the said workpiece, during the said initial inductive preheating thereof, is heated to a preheat temperature above the temperature at which the metal of the workpiece is converted into a nonmagnetic state.

7. The method as defined in claim 1 wherein a plurality of the said workpiece are progressively inductively preheated in succession in said induction heating coil to the said preheat temperature and are transferred in succession into and post-heated to said selective elevated processing temperature in the heating chamber of said furnace.

8. The method of heating an end length portion only of an elongated workpiece of magnetic metal from about ambient temperature to a selective processing temperature above the Curie point temperature of said workpiece metal comprising the steps of:

(a) initially inductively preheating the said end length portion only of the workpiece in an induction heating coil from about ambient temperature to a preheat temperature of about the said Curie point temperature of the workpiece metal; and, (b) then post-heating the said preheated end length portion only of the workpiece to the said elevated processing temperature in the heating chamber of an electric radiant heat furnace.

* * * * *